United States Patent [19]

Friedman

[11] Patent Number: 4,795,287

[45] Date of Patent: Jan. 3, 1989

[54] LOOSE LEAF HOLDER FOR USE WITH RING BINDERS

[76] Inventor: Michael N. Friedman, 7 Harbor Ct., Centerport, N.Y. 11721

[21] Appl. No.: 4,634

[22] Filed: Jan. 20, 1987

[51] Int. Cl.[4] ..... B42F 13/00; B42F 13/22; B42F 5/00; B65D 33/24

[52] U.S. Cl. ..... 402/79; 402/75; 40/405; 383/84

[58] Field of Search ..... 402/60, 61, 62, 70, 402/73, 74, 75, 76, 77, 78, 79, 80 R; 281/30, 40; 40/401, 402, 403, 404, 405; 229/126; 383/84

[56] References Cited

U.S. PATENT DOCUMENTS

| | | | |
|---|---|---|---|
| D. 275,576 | 9/1984 | Kirk | 402/79 |
| 1,807,467 | 5/1931 | Bonander | 40/405 |
| 1,812,886 | 7/1931 | Martin | 402/80 R |
| 1,854,751 | 4/1932 | Martin | 402/79 |
| 1,876,998 | 9/1932 | Martin | 402/80 R |
| 3,620,553 | 11/1971 | Donovan | 402/79 |
| 4,084,689 | 4/1978 | Yamagata | 383/84 |
| 4,571,109 | 2/1986 | Lapertosa | 402/77 |
| 4,630,843 | 12/1986 | Willat | 402/75 |

*Primary Examiner*—Paul A. Bell
*Assistant Examiner*—Paul M. Heyrana, Sr.
*Attorney, Agent, or Firm*—Bauer & Schaffer

[57] ABSTRACT

For use in a ring binder a holder for loose sheets formed of a blank folded on transverse hinge lines to form a pocket at its lower end extending across the blank and if desired a small pocket similarly formed at an upper corner. The folded portions have one common lateral edge through which a plurality of holes are formed, conforming in size and spacing to the rings of a ring type fastener so that when placed in the ring fastener the pockets are closed along at least that side. Additional closures are provided at the opposite sides.

11 Claims, 2 Drawing Sheets

LOOSE LEAF HOLDER FOR USE WITH RING BINDERS

BACKGROUND OF THE INVENTION

The present invention relates to an accessory device for ring-type binders and particularly to a pocketed holder which is adapted to be incorporated within and to become a part of a ring-type binder to hold loose papers, photographs, and similar sheet materials.

Ring-type binders are quite common and in wide use having the advantage that the materials being bound therein are easily removable and replaced when needed. However, in order to bind the material, the material itself must be provided with holes conforming to the type of ring-fastener employed. This means that the papers must be provided during its manufacture with holes, or must be separately punched with holes, prior to use. Frequently, however, neither a prepunched supply of paper, or a hole punch to make the holes are available. There is thus, a need for at least a temporary holder for retaining loose sheets, papers, and the like within the ring binders. Additionally, it is often necessary to hold documents, photographs and similar shaped material, in which it is not possible to make holes, for legal or other reasons.

It is, therefore, an object of the present invention to provide a holder for loose sheets, papers and similar objects, which holder can be used in combination with a ring-type binder so as to allow loose sheets and papers and the like to be stored while being readily accessible for use.

It is another object of the present invention to provide a holder of the type described, which is economical to fabricate and simple to use.

It is further an important object of the present invention to provide a holder of the type described having a pocket in which loose sheets, papers and similar objects are securely held in the holder, and which are retained from accidentally falling out of the holder during carrying of the binder.

It is a more specific object of the present invention to provide a holder having a pocket in which the loose sheets are held which holder is formed by folding a blank along a selected hinge line and which employs the ring fasteners of the ring-type binder to at least in part enclose the ends of the pockets formed by folding the blank.

The foregoing objects, together with other objects and numerous advantages, are set forth in the following disclosure.

SUMMARY OF THE INVENTION

According to the present invention, a holder for loose sheets, papers or similar objects, is provided for use in combination with a binder provided with a ring-type fastener having a plurality of rings. The holder comprises a elongated unitary blank of sheet material provided with holes relatively spaced along one lateral edge conforming to that of the rings of the ring fastener. The blank is divided, by a transverse hinge, into a rectangular back panel and a cover panel foldable over the back panel to form an open sided pocket wherein the holes along the one lateral edge overlie each other in alignment and registry. The blank is further provided with a closure flap extending integrally from the lateral edge opposite the holes, which closure flap folds transversely over the cover panel to close the pocket along the opposite lateral edge while the edge with the holes is closed when the folded blank is bound in the ring fasteners.

Preferably, the blank is also provided with a tabular extension at its upper edge extending along the one lateral edge having the holes. The extension is foldable along a second transverse hinge over the back panel so that the lateral edge and corresponding holes is superposed over the lateral edge of the back panel and when inserted into the rings of the ring binder closes the lateral edge of the tab at the corner of the back panel. With this construction, the holder provides retaining edges at at least three corners and along portions of four sides of the holder, two corners being formed by the pocket, and one corner by the retaining tab. Each of the corners has at least two edge sections capable of engaging the edges of the sheet material placed therein.

Full details of the present invention are set for the in the following description and in the illustrated drawings.

DESCRIPTION OF THE INVENTION

Figure 1:
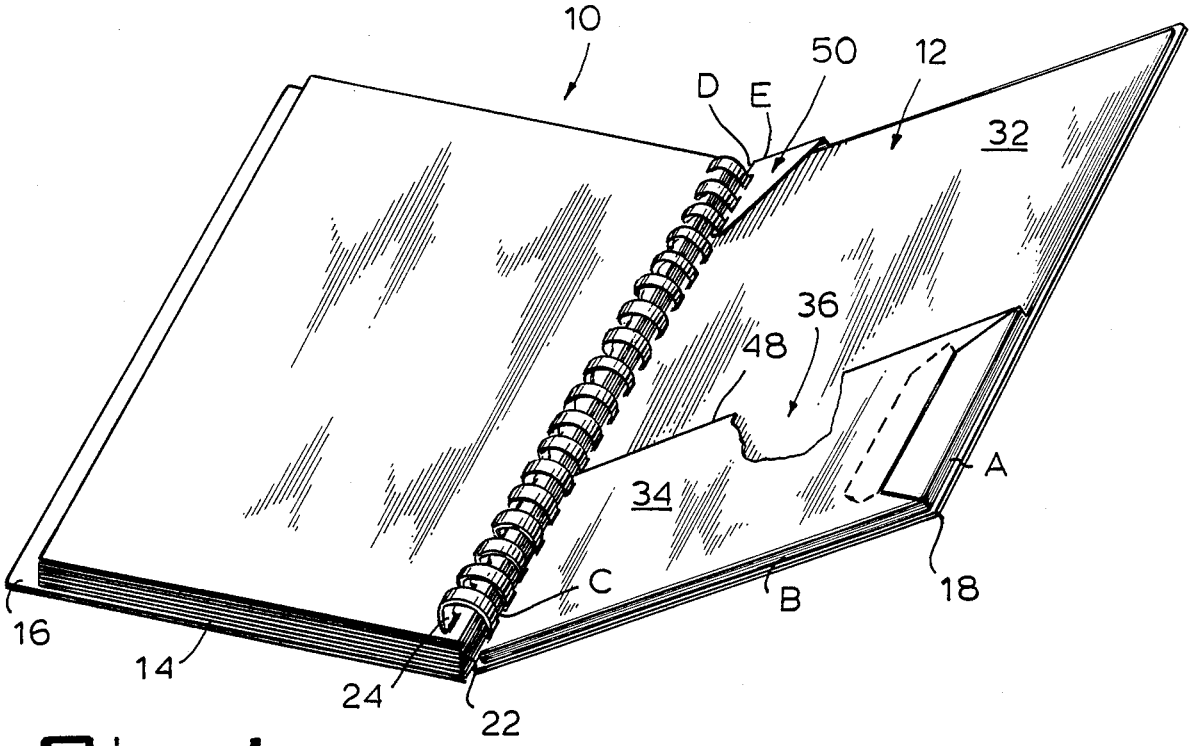
FIG. 1 is a perspective view of a ring-type binder and the combination of the holder of the present invention applied thereto.

Referring to FIG. 1, a looseleaf ring binder shown generally by the numeral 10 is combined with a pocketed file or paper holder formed in accordance with the present invention, shown generally by the numeral 12. The bonder 10 comprises a plurality of loose paper sheets 14 held within a pair of hinged covered members 16 and 18 by means of a ring type fastener 20. The illustrated binder and its ring type fastener are representative of any one of a variety of binders and ring binders commercially available. The cover members 16 and 18 may be made of paper, cardboard, composition material, plastic, or even metal.

The ring type fastener 20 can be individual rings, spiral rings, or group rings operable individually or in sets, made of metal and/or plastic. The sheets 14 are perforated along one lateral edge 22 with holes 24 which correspond in spacing, and substantially in size and shape to the rings of the fastener 20. Thus, if the rings of the fastener are circular, then the perforations may also be circular holes. On the other hand, if the rings of the fastener are relatively flat and wide, then the perforations may be made with the same shape and relative shaping so that the sheets 14 may be easily mounted and removed from the ring binder.

In general, the binder 10 just described is conventional in nature and the present invention is not intended to modify or otherwise change the form of the binder. Any one of variety of types of binders currently marketed including applicant's as taught in U.S. Pat. No. 4,374,627, can be employed with the present invention, the pocketed holder of the present invention being merely adapted as will be seen to have perforations or holes which fit within the given or selected form of binder employed.

Figure 2:
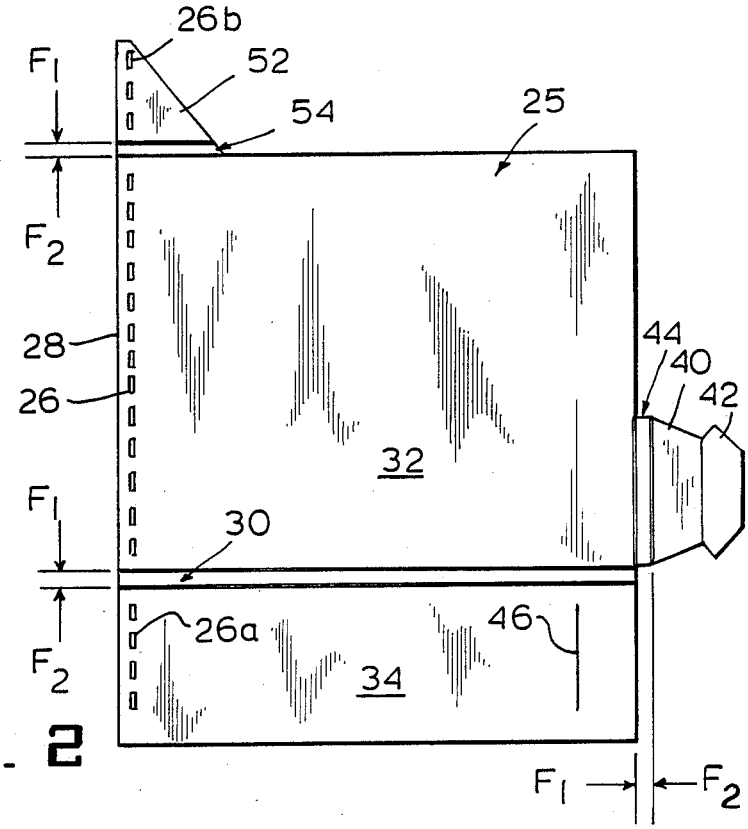
FIG. 2 is an overall plan view of a unitary blank used in forming the holder in FIG. 1.

Referring to FIG. 2, the holder 12 is constructed from an elongated unitary blank 25 which is die cut or otherwise formed from any suitable paper, plastic, or similar stock sheet material. As the description proceeds, it will be apparent that the blank 25 may actually form the cover 16 or 18 or both. The blank is provided with a plurality of perforations 26 along one lateral edge 28 (hereinafter sometimes referred to as the inner edge, since it is the edge by which it will be eventually secured within or as a part of the ring fastener) and is divided by a transverse hinge 30 into a rectangular back panel 32 preferably sized and shaped as desired or to conform to that of the front and back cover members 16 and 18. A cover panel 34 of the same width is significantly shorter in the longitudinal dimension so as to define with the back panel 32 a pocket 36 (see FIG. 1 and 3) when the two are folded over or under each other.

When folded, the inner lateral edges 28 of the back panel 32 and the cover panel 34 become superposed and the holes 26*a* in the cover panel 34 align and register with the holes 26 in the back panel 32. To insure alignment and registry of the holes, one or more holes may be omitted within the below the area of the hinge 30, and the spacing between those in the back panel and cover panel selectively determined or the holes 26*a* may be moved to assure their alignment and registration with the holes 26. The holes are preferably formed in size and shape to conform to the rings of ring-fastener 20.

Extending integrally from the outer lateral edge 38 is a closure flap 40 provided with a terminally extending shaped tab 42. The flap 40 is adapted to fold about a longitudinal hinge 44 and has a longitudinal dimension equal to that of the cover panel 34 and a transverse dimension sufficient to easily extend over the end of the cover panel 34. The cover panel 34 is provided with a narrow slit 46 adapted to the receive the tab 42 so as to hold it fixedly in place albeit removable therefrom.

Thus, when the cover panel 34 is folded over or under the back panel 32 and the closure flap 40 is folded over (or under) the cover panel 34, and the closure tab 42 inserted in the slit 46 the pocket 38 is formed, having an open entrance or mouth 48, as seen in FIG. 1. When the thus folded blank 25, now considered to be a complete pocketed holder 12, is inserted into the ring fastener 20, the registering holes 26 and 26*a* along the inner lateral edges 28, are engaged and retained by the rings of the fastener that extend therethrough, thereby defining one side of the pocket 36, which is closed and is effectively sealed. The pocket 36 is closed about three of its four peripheral edges indicated by A, B, and C in FIG. 1. By a different aspect, pocket 36 is closed by its two lower corners and by at least four edge sections.

The holder 12 is preferably completed (as seen in FIG 1) with a relatively smaller triangular pocket 50 at its upper inner corner, by providing the blank 25 (as seen in FIG. 2) with an integral triangular extension 52 foldable along a hinge 54 parallel to the hinge 30 about which the cover panel 34 is folded. The triangular tab 52 has a common inner edge with the backpanel 32 and conforming holes 26*b*. The extension 52 is shown preferably in the form of a right triangle in which the perpendicular arms are formed by the hinge 54 and the inner lateral edge 28, so that when the extension 52 is folded over (or under depending upon the folding of the lower panel 34) the holes 26*b* in the extension 52 also register with the holes 26 in the back panel 32 as in the manner described with respect to the registry of holes 26*a* thereby forming the small triangular second pocket 50 having peripheral walls closed at D by the ring fastener 20 and at E by the hinge 54.

In the preferred form of the invention, each of the hinges 30, 44 and 54 are formed by space parallel fold lines F1 and F2 so that when the panels, flaps and extensions are folded, the walls A through E each have a height equal to the distance between fold lines F1 and F2 thus giving depth to the pockets 36 and 50. Consequently, a file or a plurality of loose sheets can easily be accommodated in these pockets 36 and 50, without destroying or unduly distending the size of the pockets. A spacing of approximately $\frac{1}{8}$ to $\frac{3}{8}$ths of an inch between fold lines F1 and F2 is probably sufficient for the generally conventional binders although for binders having a large spine thickness, the spacing between F1 and F2 can be conformedly larger. Preferably, the spacing of the fold lines F1 and F2 of the hinge 44 is slightly larger than the distances between the fold lines F1 and F2 of the other hinge lines 30 and 54, so as to accommodate the added thickness of the cover panel 34 itself, which lies beneath the closure flap 40 when the blank is in the folded condition as seen in the detail of FIG. 3.

Figure 3:
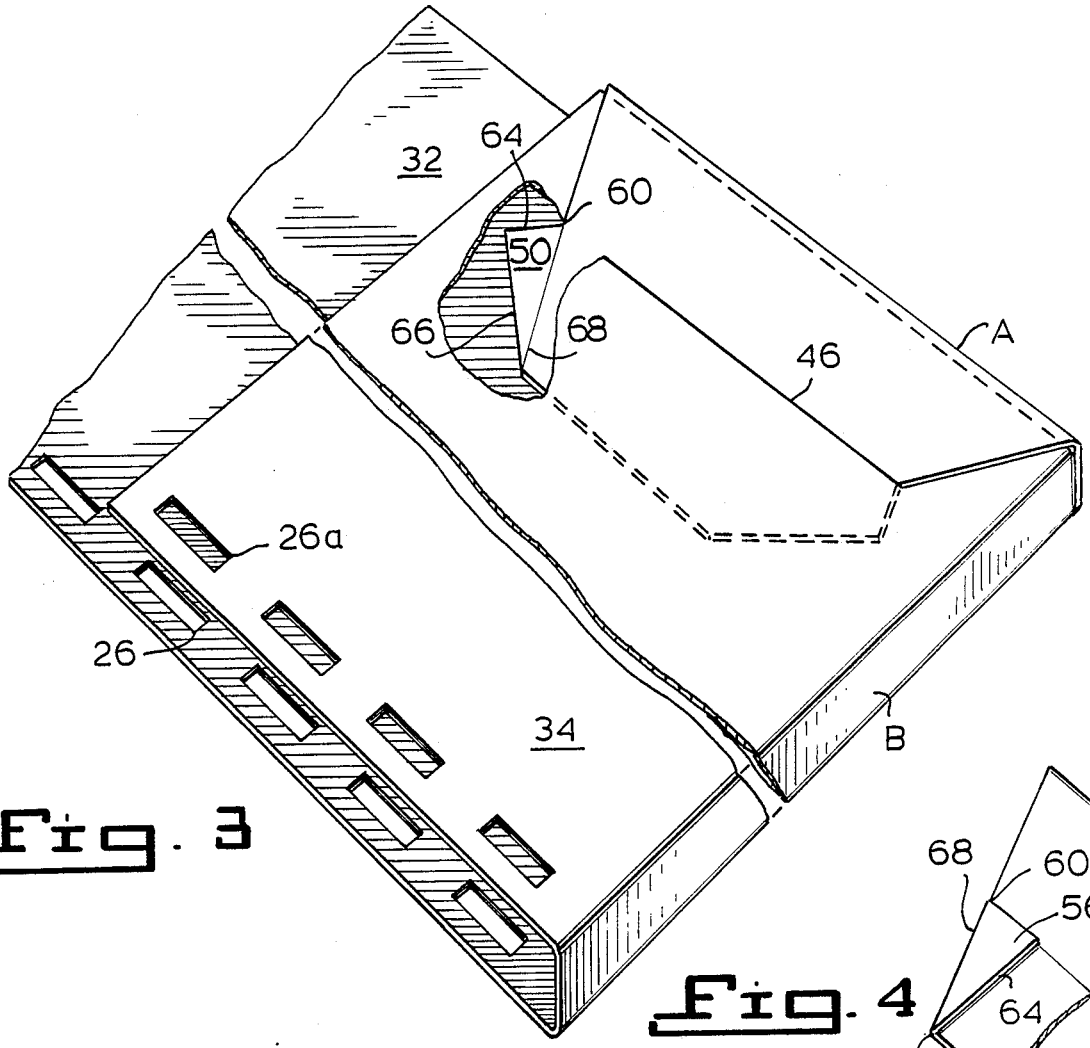
FIG. 3 is an enlarged view of the lower portion of the holder shown in FIG. 1.
Figure 4:
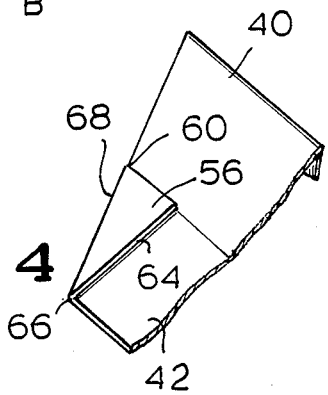
FIG. 4 is an enlarged view showing the detail of the closure flaps, by which the lower pocket is completed.

As seen in FIGS. 3 and 4, the insert tab 42, at the end of the closure flap 40 which is itself trapizoidally shaped, is preferably provided with a pair of laterally oppositely pointing wings 56 substantially like that of an arrowhead each having rear side edges 58 which flare outwardly with respect to each other from a base point 60, and a forward side edge 64, in a return taper extending from tip 62 to a point 66 on to a tip 62. the distance between the base points 60 is approximately equal to the size of the slit 46 formed in he cover panel 34, while the distance between the wing tips 62 is substantially greater. In this manner, once the inset tab 42 is inserted in the slit 46 a secure lock with the cover panel 34 will be obtained.

To facilitate insertion of the tab 42 within the slot, the inset tab 42 is scored along the extension 68 to form a fold line along which the wings 56 can be folded. The fold lines 68 extend from the base points 60 so that when wings 56 fold, the tab 42 becomes substantially pointed and substantially smaller than the slit 46 into which it is inserted. At that time, the wings 56 fold substantially flat against the body of the tab 42 and their fold lines 58 form a narrow arrowhead continuation for the larger body part of the tab. This facilitates entering of the tab 42 into the slit 44 but allows the wings 56 to automatically open, one fully inserted resulting in the locking the of tab 42 in place.

Figure 5:
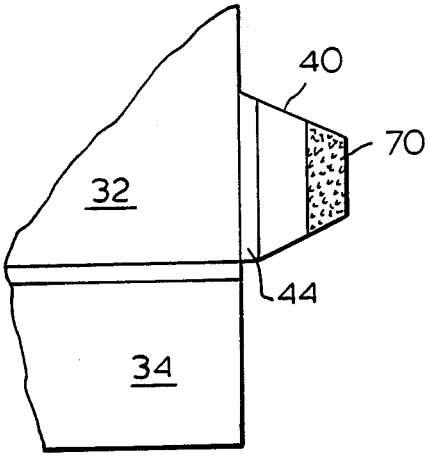
FIG. 5 is a view of the portion of the blank showing the application of "Velcro" to the flap.
Figure 6:
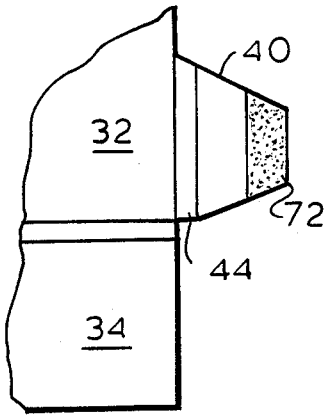
FIG. 6 is a view similar to FIG. 5, showing the application of adhesive to the flap.

It will be apparent, that the closure flap 40 can be made integral with the cover panel 34 rather than the back panel 32 and thus made to interlock with a slit in the back panel. The flap 40 can also be formed in other ways than that shown in the drawings. Particularly, rather than providing a terminally extending tab 42 and slit 46 the closure flap 40 and cover panel 34, may be provided with a cooperating adhesive means, i.e. Velcro, contact tape, or the like, by which once the two members are folded over each other, they can be automatically adhered to each other. In FIG. 5, the flap 40 is shown with Velcro 70, while in FIG. 5 the flap 40 is shown with adhesive 72. The cover panel 34 may be comparatively provided with the complementary materials on the under surface as shown in each of the FIGS. 5 and 6. In addition, the closure flap 40 may be so elongated that it extends completely across the back panel and may also be provided with a series of holes along its lateral edge which holes will be aligned and in registry with the holes 26 and thereby be simultaneously bindable within the ring binder.

The transverse or width-wise extension of the upper tabular extension 52, forming the pocket 50 and its triangular shape, may also be varied, provided that fold line 54 remains essentially perpendicular to the inner lateral edge 28 of the blank 25, and the inner lateral edge of the extension 52 is superposed over the corresponding edge of the back panel 32 so as to be simultaneously bindable in the binder. Thus, if it is desired that the pocket 50 fully enclose the top of the loose sheets stored in the holder 12, the extension 52 will be made to extend from its right end fully across the full width of the back panel 32. The right edge of the pocket 50 is preferably left open to facilitate insertion of papers thereinto and their removal therefrom.

It is foreseeable that when the extension 52 extends more than half the width across the top of the back panel 32, it may unduly restrict the articles as they are inserted into or are removed from the pocket 50 and thus may inhibit free access to such articles. In such case, it may be desirable to make the holes 26*b* in the extension 52 incomplete or to provide them with slots that open at the edge 28 so as to enable the extension 52 to be easily released thereof from its engagement with the rings of the fastener 20 allowing the pocket 50 to be opened and thereafter closed. This type of arrangement can best be provided when forming a holder of rather heavy oak tag or cardboard stock or of plastic stock since such material has greater resiliency and strength against destruction, while providing it sufficient rigidity to permit repeated closing and opening. In this connection, it will be quite obvious that the material from which the blank 25 can be made can be of any type of flexible material and should not be limited to any particular stock.

By providing a holder 12 in which a major pocket such as pocket 36 is formed, which is at least in part held and retained by the enclosing ring portions of the ring fastener, a simplified holder is provided quite economical. The articles are enclosed at least along four contacting portions of the side walls, namely along the edges defined by the two corners of the pocket, i.e. A, B and B, C respectively. By further providing the additional pocket 50 at its upper inner corner, the holder retains and prevents the loss of sheets or files of varying shapes and sizes within a additional pair of edge portions, i.e. D and E, even when the holder is handled roughly and shaken severely.

Various embodiments, changes and modifications have been suggested and others will be apparent to those skilled in the art. Accordingly, it is intended that the present invention be taken as illustrative of the present invention and not limiting thereof.

What is claimed is:

1. An accessory holder for holding loose papers and sheet like materials in combination with a looseleaf binder having a ring-type fastener comprising an elongated unitary blank of sheet material having ring fastener holes relatively spaced along one lateral edge in conformity in number with the relative spacing of the rings of said ring-type fastener, said blank being divided along a first transverse hinge line into a rectangular back panel and a cover panel, said back panel being formed with a second transverse hinge line spaced from and parallel to said first hinge line and being foldable over said back panel with the ring fastener holes in said cover and back panels aligned in registry with a connecting wall having a depth corresponding to the distance between said first and second hinge lines to form a pocket open along its upper edge and being closed at one lateral end by inserting the rings of said fastener into said aligned holes of said cover and back panels, and at its other lateral end by a flap extending integrally from the other lateral edge of said blank and foldable perpendicularly to said transverse hinge lines into interlocking engagement with a selected one of said cover and back panels, whereby said pocket is coextensive with the transverse dimension of said back panel, closed on three sides, and having a depth accommodating a plurality of loose sheets.

2. An accessory holder for holding loose papers and sheet like materials in combination with a looseleaf binder having a ring-type fastener comprising an elongated unitary blank of sheet material having ring fastener holes relatively spaced along one lateral edge in conformity in number with the relative spacing of the rings of said ring-type fastener, said blank being divided along a first transverse hinge line into a rectangular back panel and a cover panel foldable over said back panel with the ring fastener holes in said cover and back panels aligned in registry, a pocket open along its upper edge and being closed at one lateral end by inserting the rings of said fastener into said aligned holes of said cover and back panels, and at its other lateral end by a flap extending integrally from the other lateral edge of said blank and foldable perpendicularly to said transverse hinge lines into interlocking engagement with a selected one of said cover and back panels, a tabular panel extension at the upper edge of said back panel, said tabular extension having a lateral edge coextending with the one lateral edge of said back panel and having ring fastener holes aligned with ring fastener holes in said back panel, said tabular panel extension extending from said one lateral edge toward said other lateral edge a fraction of the distance therebetween and being connected to said back panel along a transverse hinge line, said tabular panel extension being folded over said back panel with said coextending lateral edges superposed and said holes aligned in registry to form a triangular second pocket with said base panel when the rings of said fastener are inserted therein, each of said hinge lines being formed by a pair of parallel fold lines so as to form pockets having connecting walls between said back panel, said cover panel, and said panel extension, respectively, of a depth corresponding to the distance between said fold lines.

3. The holder according to claim 3, wherein said flap and said selected one of the cover and back panels to which it is in folded interlocking engagement have cooperating means for removably interlocking said flap and said one selected panel.

4. The holder according to claim 3, wherein said interlocking engagement means comprises an extending substantially arrowhead shaped tab formed at the end of said flap and a slit formed in the body of said one selected panel.

5. The holder according to claim 4 wherein said substantially arrowhead shaped tab is formed with oppositely extending wings foldable inward toward each other to reduce the width of the end of said flap and being openable to a size wider than the extent of said slit once inserted therein to engage and lock against the ends of said slit.

6. The holder according to claim 3, wherein said flap and said one selected panel are provided with cooperating adhesive means for fixedly securing said flap to said one panel.

7. The holder according to claim 3, wherein said flap and said one selected panel are provided with cooperating VELCRO means for fixedly securing said flap to said one panel.

8. The holder according to any one of claims 1 to 6, wherein said flap is folded along a pair of parallel relatively spaced fold lines whereby in folding said panels and flap said pocket is formed with a peripheral and wall having a depth corresponding to the depth of the connecting wall.

9. A holder for loose sheets, paper files and similar objects for use in combination with a binder provided with a ring-type fastener having a plurality of relatively spaced rings, said holder comprising a back panel, an integrally attached cover panel at its lower end and an integrally attached extension panel at its upper end, said panels having a common lateral edge and said panels being folded with respect to each other to form a first pocket between said cover panel and back panel, and a second pocket between said extension panel and said back panel, each of said pockets having their common lateral edges superposed, a plurality of relatively spaced aligned holes formed through said panels, adjacent said superposed lateral edges conforming in number and relative spacing to the rings in said ring-type fastener permitting said holder to be bound in said binder and closing said first and second pocket along said superposed lateral edges, and a flap extending from a selected one of said cover and back panels folded into contact with the other of said panels to close said pocket opposite the said superposed lateral edges, said extension, cover and back panels, being folded about parallel spaced fold lines to provide peripheral walls about said first and second pocket having a depth the equivalent to the space between said fold lines, said flap being folded about parallel spaced fold lines at least equivalent to the depth of the peripheral wall and the thickness of the other selected panel.

10. A blank for forming an accessory for holding loose papers and sheet-like materials in combination with looseleaf binder having a ring-type fastener comprising an elongated unitary blank of sheet material provided with holes relatively spaced along one lateral edge conforming to the relatively spaced rings of the ring-type fastener, said blank being divided by a pair of transverse hinges into a rectangular back panel and a cover panel foldable against the lower portion of said back panel to form a first pocket having open sides, and a tabular panel foldable against the upper portion of said back panel to form a second pocket wherein the holes along the one lateral edge of said panels overlie each other in registry, the first and second pockets being closed along the one lateral edge when said folded blank is bound in said ring-type fastener with the rings of the fastener extending through said holes of said blank and panels, and means on said blank to close said first pocket such that said first and second pockets define at least a partial enclosure on four sides to engage and retain papers and other materials therein and to said looseleaf binder.

11. The blank according to claim 10 wherein said means includes a flap extending integrally from the opposite lateral edge of said blank and being separated therefrom by a hinge to be foldable to close the first pocket along the other lateral edge.

* * * * *